US006152837A

United States Patent [19]

Reid

[11] Patent Number: 6,152,837

[45] Date of Patent: Nov. 28, 2000

[54] GOLF TEE

[75] Inventor: Curtis B. Reid, County of Macomb, Mich.

[73] Assignee: Pin-Amax Golf Products, LLC, Bloomfield Hills, Mich.

[21] Appl. No.: 09/250,355

[22] Filed: Feb. 16, 1999

[51] Int. Cl.[7] ..... A63B 57/00

[52] U.S. Cl. ..... 473/387; 473/392

[58] Field of Search ..... 473/387–403, 473/417, 420; D21/717, 718

[56] References Cited

U.S. PATENT DOCUMENTS

| | | | |
|---|---|---|---|
| D. 208,711 | 9/1967 | Ward | D21/717 |
| D. 376,830 | 12/1996 | Bess | D21/717 |
| 1,599,310 | 9/1926 | Wiley | 473/388 |
| 1,933,239 | 10/1933 | Boe | 473/388 |
| 2,555,222 | 5/1951 | Coleman et al. | 473/390 |
| 3,309,087 | 3/1967 | Cullity | 473/420 |
| 3,697,082 | 10/1972 | Di Laura et al. | 473/387 |
| 5,503,396 | 4/1996 | Veylupek, Jr. et al. | 473/388 |

*Primary Examiner*—Steven Wong

[57] ABSTRACT

A golf tee is provided. The golf tee includes a ball support, legs extended forwardly and rearwardly from the ball support. Further, the legs extend downwardly and terminate in a foot. Forward pairs of legs are connected by a front web. Rearward pairs of legs are connected by a rear web. The height of the tee can be adjusted by moving the front and rear pairs of legs relative to one another, preferably by applying a force on the front and rear webs.

8 Claims, 1 Drawing Sheet

GOLF TEE

BACKGROUND OF THE INVENTION

1. Field of the Invention

The present invention relates to a golf tee.

2. Description of the Prior Art

Golf tees typically comprise a ball support and a stem. The stem is partially inserted into the ground and provides a mechanism to set the ball at a raised position with respect to the ground. Standard tees are disadvantageous in that the tee height potentially changes every time the tee is inserted into the ground, providing inconsistent tee shots.

One known solution to this problem is to provide an annular ring molded about the exterior of the shaft at a predetermined distance from the ball support. This solution does provide for consistent height of the ball support with respect to the ground. The major disadvantage of this system is that the height is set at a predetermined distance at the time the tee is manufactured, and may not be the desired height for every golfer.

SUMMARY OF THE INVENTION

According to the present invention, there is provided a golf tee that comprises a ball support and at least two ground engaging members. The ground engaging members extend downwardly and outwardly from the ball support.

One advantage of the present invention is that the ground engaging members can be moved relative to one another to adjust the height of the ball support with respect to the ground.

Another advantage of the present invention is the minimal ground penetration of the ground engaging members, thus resulting in consistent height of the ball support with respect to the ground.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
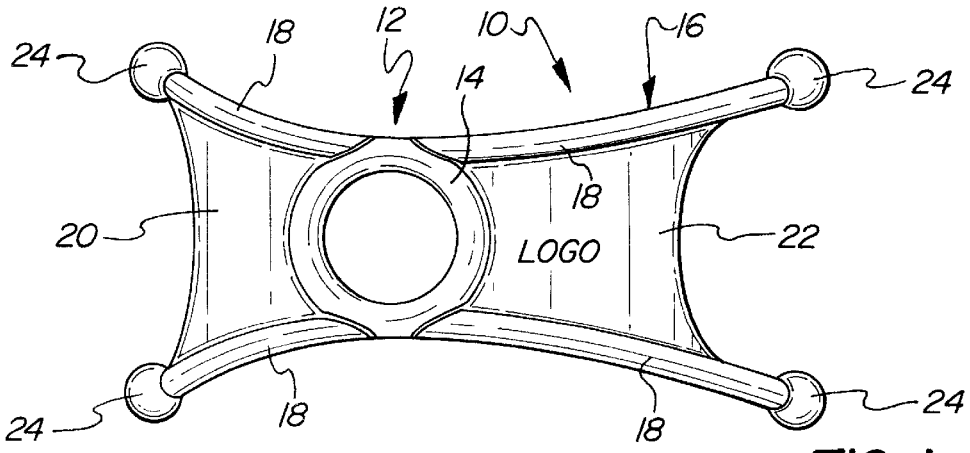
FIG. 1 is a top plan view of the preferred embodiment of the present invention.

A golf fee according to the present invention is generally shown at 10 in the Figures. The tee 10 includes an annular ball support generally indicated at 12. The annular ball support 12 preferably comprises an annular ball support surface 14. The ball support surface 14 is for supporting a golf ball (not shown) during tee shots.

The golf tee further includes at least two ground engaging members generally indicated at 16. The ground engaging members 16 extend downwardly and outwardly from the ball support surface 14. The ground engaging members 16 are preferably flexible and can flex relative to the ball support surface 14. By flexing the ground engaging 16 relative to the ball support surface 14, the height of the ball support surface with respect to the ground can be adjusted.

Figure 2:
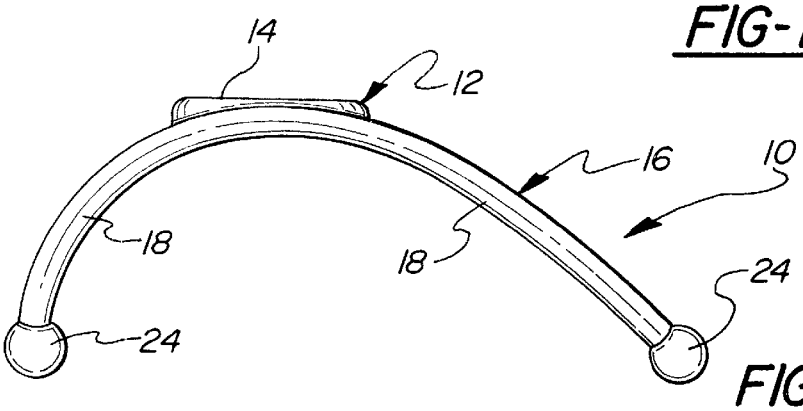
FIG. 2 is a side elevational view of the preferred embodiment of the present invention.
Figure 3:
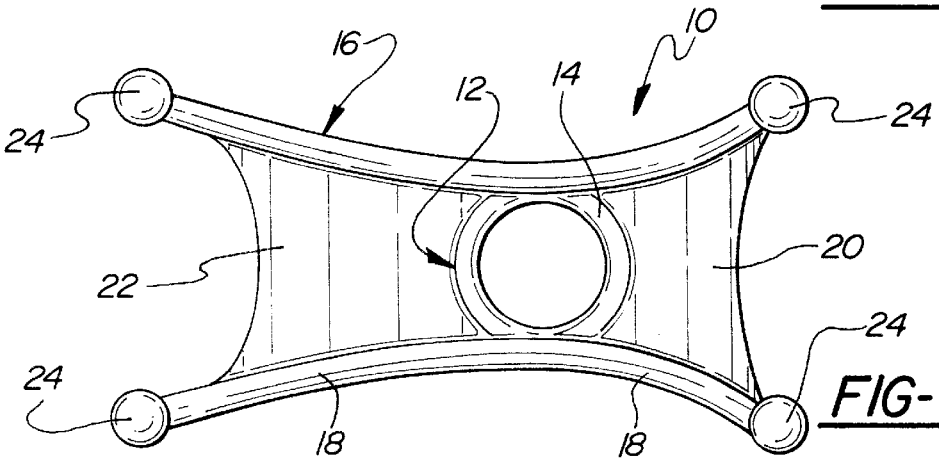
FIG. 3 is a bottom view of the preferred embodiment of the present invention.
Figure 4:
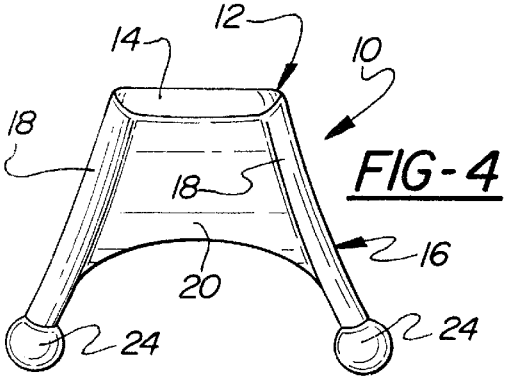
FIG. 4 is a front elevational view of the preferred embodiment of the present invention.
Figure 5:
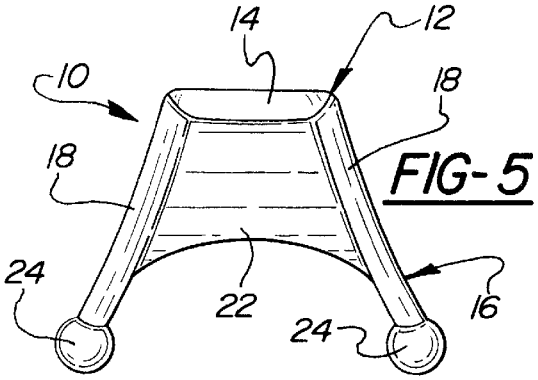
FIG. 5 is a rear elevational view of the preferred embodiment of the present invention.

In the preferred embodiment, the ground engaging members 16 preferably comprise legs 18. The legs 18 are connected to the ball support 12 and extend downwardly and outwardly therefrom. The legs 18 are preferably arcuate. Further, four legs 18 are shown. Two of the legs 18 are forward of the ball support 12, and two are rearward or aft of the ball support 12. AS best seen in FIGS. 2 and 3, the pairs of fore and aft legs 18 may also be connected.

It is also preferred that the legs 18 extend from the ball support 12 from a position below the top of the ball support surface 14, so as to limit interference of the legs 18 with a golf club used to strike a ball held on the ball support surface 14.

The fore pair of legs 18 are interconnected by a forward web 20. The aft or rear pair of legs 18 are connected by a rear web 22. The webs 20,22 preferably are solid thin sheets of material that are flexible. The webs 20,22 are preferably thinner than the diameter or thickness of the legs 18. The webs 20,22 aid in the flexing of the legs 18. That is, pressure applied to the webs 20,22 will flex the respective pair of legs 18 relative to the ball support surface 14 as will be detailed below. The webs 20,22 also provide a surface for imprinting a name or logo, so that the tee can also be used as a promotional item. The webs 20,22 can take any ornamental configuration within the scope of the present invention.

The legs 18 terminate in a foot 24. The foot 24 preferably comprises a generally spherical shape or knob 24. The knob 24 helps maintain the tee 10 above the ground and aids in limiting the insertion of the legs 18 into the ground, as will be described below. It will be appreciated that the foot 24 can take any shape that helps maintain the majority of the tee 10 above the ground.

The tee 10 is preferably made of a resilient plastic material. The tee 10 is preferably injection molded as a unitary structure. Any suitable plastic material can be used. It is preferred that the material be flexible to allow the flexing of the legs 18, and yet be strong enough to withstand the impact of a golf club during normal use.

To use the golf tee 10 of the present invention, the golfer simply places the tee on the ground such that the feet 24 rest on the ground. A ball is then placed on the upper ball support surface 14 and the tee 10 is ready to be used. To change the height of the ball support surface 14, and hence the ball, relative to the ground, the golfer simply adjusts the legs 18. More specifically, by pulling outwardly (relative to the ball support 12) on the legs 18 (preferably by exerting a pulling force on the webs 20,22), the legs will tend to flatten out, thus reducing the height of the ball support surface 14 relative to the ground. By pushing inwardly (relative to the ball support 12) on the legs 18, the legs will tend to become more arcuate and raise the height of the ball support surface 14 relative to the ground. Once the desired height is achieved, the golfer simply places the tee 10 on the ground and places a ball on the ball support surface 14. Because the tee is preferably made from a resilient plastic material, it can withstand the flexing and can generally maintain the position to which it has been adjusted. This allows the golfer to have a tee that allows the ball to be teed up to the same height every time the tee is used.

As shown in the Figures, the tee 10 also aids the golfer in addressing the ball squarely. Specifically, the tee 10 can be used pointed in any direction. But, to aid the golfer in squaring the club face to the target, it is preferred that the tee 10 be used such that the front and rear legs 18 point in a direction either pointing directly at the target or perpendicular to the target. This visual aid allows the golfer to more easily square the club face to the intended target.

The ground engaging members 16 may take any configuration within the scope of the present invention. It will be appreciated, however, that the ground engaging members are intended to hold the golf tee above the ground, and can be flexed, at least to some degree, to adjust the height of the ball support surface 14 with respect to the ground.

Further, it is preferable that the foot 24 rest on the ground to provide a consistent height for the golf ball. It is, however, within the scope of the present invention to include a ground penetration member, such as, for example, a small spike or pointed surface on the end of the ground engaging member 16 or foot 24 to be inserted, to some degree, into the ground. Such modification will allow only slight insertion of the ground engaging member 16 into the ground. The foot 24 is not intended to be inserted into the ground. In this manner, the golfer can be assured that the tee height, with respect to the ground, is consistent.

The invention has been described in an illustrative manner, and it is to be understood that the terminology which has been used is intended to be in the nature of words of description rather than of limitation. Obviously, many modifications and variations of the present invention are possible in light of the above teachings. Its is, therefore, to be understood that within the scope of the appended claims, the invention may be practiced otherwise than as specifically described.

What is claimed is:

1. A golf tee comprising:

a ball support a plurality of arcuate legs extending downwardly and outwardly from said ball support, at least one of said legs extending generally fore of said ball support and at least one of said legs extending aft of said ball support.

2. A golf tee as set forth in claim 1 wherein said ground engaging members are flexible and can flex with respect to said ball support for adjusting the height of said ball support relative to the ground.

3. A golf tee as set forth in claim 2 wherein each of said legs extends outwardly and downwardly from said ball support to a foot.

4. A golf tee as set forth in claim 3 wherein said foot comprises a knob to rest on top of the ground to limit insertion of the legs into the ground.

5. A golf tee as set forth in claim 3 including four of said legs, two of said legs extending generally fore of said ball support and two of said legs extending aft of said ball support.

6. A golf tee as set forth in claim 5 wherein said forward legs having a web therebetween.

7. A golf tee as set forth in claim 5 wherein said aft legs have a web therebetween.

8. A golf tee comprising:

a ball support;

four flexible, arcuate legs extending downwardly and outwardly from said ball support to a foot, a forward pair of said legs extending generally forwardly of said ball support and a rearward pair of said legs extending generally rearwardly of said ball support, said forward pair having a web therebetween and said rearward pair having a web therebetween.

* * * * *